US005435602A

United States Patent [19]

Fastovsky

[11] Patent Number: 5,435,602

[45] Date of Patent: Jul. 25, 1995

[54] LOTTERY TICKET, AND METHOD OF PRODUCING THE SAME

[76] Inventor: David Fastovsky, 1618 E. 15 St., #2A, Brooklyn, N.Y. 11229

[21] Appl. No.: 28,817

[22] Filed: Mar. 10, 1993

[51] Int. Cl.[6] ..... B42D 15/00

[52] U.S. Cl. ..... 283/117; 283/903

[58] Field of Search ..... 283/117, 903

[56] References Cited

U.S. PATENT DOCUMENTS 5,100,139 3/1992 Di Bello ..... 283/903 X 5,118,109 6/1992 Gumina ..... 283/903 X 5,158,293 10/1992 Mullins ..... 283/903 X

*Primary Examiner*—Paul A. Bell

*Attorney, Agent, or Firm*—Ilya Zborovsky

[57] ABSTRACT

A lottery ticket is produced by first photographing by a user a plurality of images, printing the photographed images onto a carrier, providing on the carrier a plurality of numbers corresponding to the images so that when the player crosses out several images he identifies several numbers to play in a lottery, and arranging on the ticket symbols which identify the player.

1 Claim, 1 Drawing Sheet

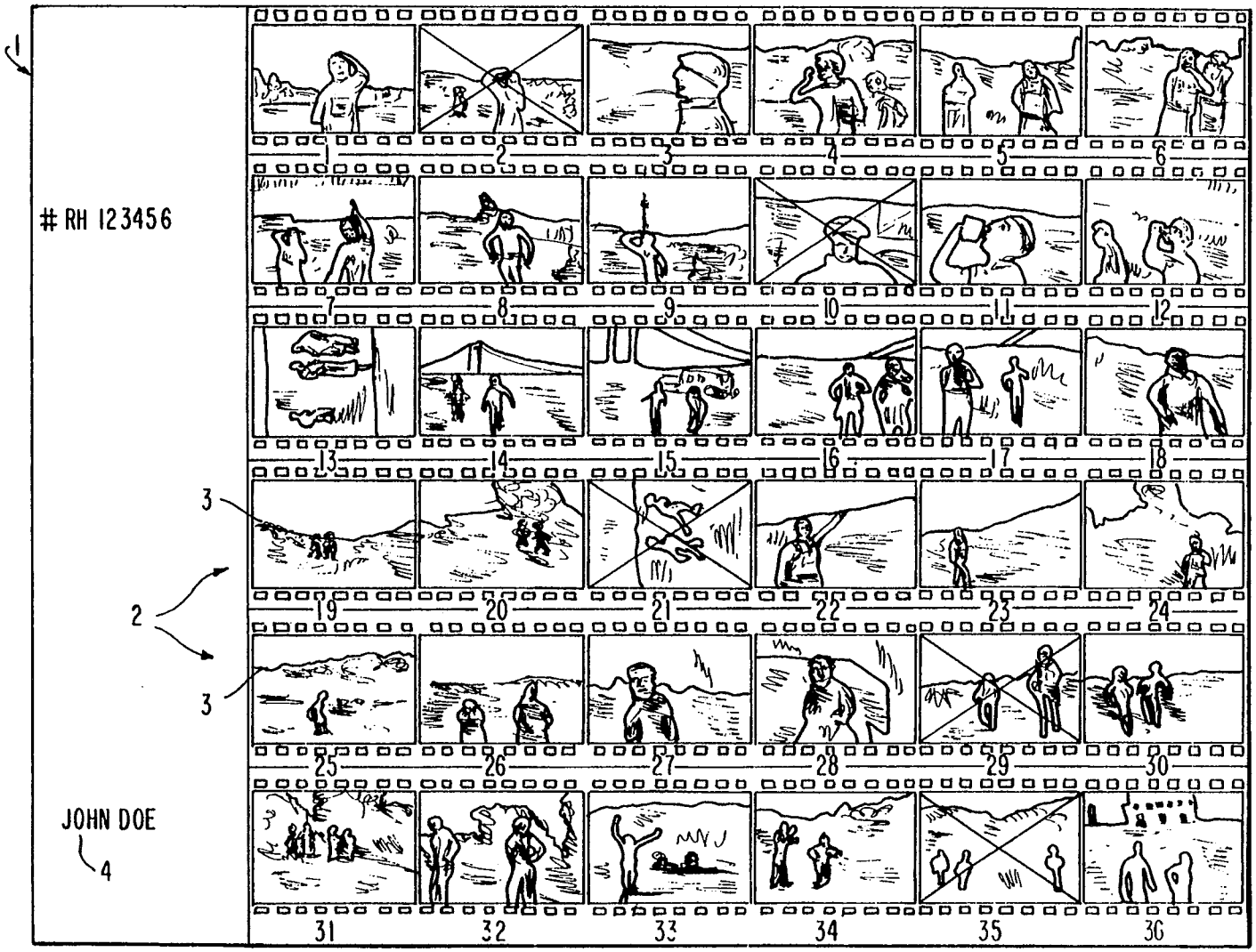
#RH 123456
JOHN DOE
1
2
3
4

LOTTERY TICKET, AND METHOD OF PRODUCING THE SAME

BACKGROUND OF THE INVENTION

The present invention relates to a lottery ticket and method of producing the same.

In known lottery ticket usually a plurality of numbers are provided, so that a user can cross out several numbers and thereby identify the number with which he plays the lottery. After a centralized drawing, the player and the lottery authorities can determine whether the player correctly guessed the numbers or not. The lottery tickets are not connected with any activities or hobbies of each particular player, and their content is usually limited to numbers. It is believed that the existing tickets can be further improved.

SUMMARY OF THE INVENTION

Accordingly, it is an object of the present invention to provide a new lottery ticket and a method of producing the same, which is an improvement of the existing tickets and methods.

In keeping with these objects and with others which will become apparent hereinafter, one feature of the present invention resides, briefly stated in a lottery ticket in which the carrier is provided with a plurality of areas with a plurality of images which have been photographed by a potential player so that at least one of the images is located in each of the areas, a plurality of numbers each associated with a respective one of the images and therefore a respective one of the areas so that the potential user can cross out several of the images and thereby identify several numbers selected by him for playing, and symbols identifying the potential players.

The novel features of the present invention are set forth in particular in the appended claims. The invention itself, however, both as to its construction and method of manufacture will be best understood from the following description of preferred embodiments which is accompanied by the following drawings.

BRIEF DESCRIPTION OF THE DRAWINGS

The single FIGURE of the drawings is a view which schematically shows a lottery ticket in accordance with the present invention.

DESCRIPTION OF PREFERRED EMBODIMENTS

A new lottery ticket in accordance with the present invention is produced in accordance with the inventive method as follows.

A potential player photographs objects on a regular photographic film having for example 36 exposures. The photographic activity is a hobby for millions of people, and therefore many more people make photographs than play lottery. When the player finishes photographing of the complete film, he brings the film to a film processing and picture making facility. The facility, in addition to performing of usual photography works, such as development of negatives, transparencies, making pictures, etc. prints out on a sheet of a photographic papers all exposures from the film. Advantageously, the exposures are printed so that a carrier is produced with 6 rows and 6 columns, or 36 areas each containing an images from the corresponding exposure. Two such identical carriers are produced, one to be kept by the player and the other to be submitted to a lottery authorities. The carrier as a whole is identified with references numeral 1 as a whole, while its areas are identified as 2 and the images in the areas are identified as 3.

The carrier is further provided with a plurality of numbers 1–36 each associated with a respective one of the areas 2 and thereby with a respective one of the images 3, so that each number identifies the corresponding area or images. Each carrier has symbols which identify the player, see reference numeral 4. The symbols can include the name of the player and/or the corresponding special number.

In order to paticipate in the lottery, the player crosses out several images or areas, for example 5 images or areas out of 36. One carrier is mailed or the information about it is transmitted to the lottery authorities. The drawings is performed by 36 balls for 5 winning numbers, as usual. If numbers of the cross out images or areas on the carrier coincide with the numbers drawn by the authorities, the player wins. It is to be understood that the magnitude of the award can depend on how many winning numbers the player correctly guessed.

In accordance with another embodiment of the present invention, the carrier can contain 24 areas with images which are printed from a 24 exposure photographed film. In accordance with still another embodiment, the carrier can contain 48 areas with images which are printed on a single sheet/carrier from 2 films each having 24 exposures.

The invention is not limited to the details shown since various modifications and structural changes are possible without departing in any way from the spirit of the invention.

What is desired to be protected by Letters Patent is set forth in particular in the appended claims.

I claim:

1. The new use as a lottery ticket of a photography print, comprising a plurality of images which have been photographed by a potential player of a lottery and then printed out to form the photography print with a plurality of areas such that at least one of the printed images is located in each of the areas, and providing said photography print also having a plurality of numbers each of the said numbers being associated with a respective one of the areas and thereby with a respective one of the said printed images, said new use comprising the steps of crossing out at least one of the said printed images thereby identifying at least one of the said numbers as having been selected for playing the lottery with the lottery ticket; and arranging on the photography print symbols identifying the potential player of the lottery.

* * * * *